US006397422B1

(12) United States Patent
Maziere

(10) Patent No.: US 6,397,422 B1
(45) Date of Patent: Jun. 4, 2002

(54) PROCESS FOR WASHING LINEN AND WASHING MACHINE PERFORMING SAID PROCESS

(75) Inventor: André Maziere, St Parres (FR)

(73) Assignee: Electrolux Systemes de Blanchisserie, Rosieres-Pres-Troyes (FR)

( * ) Notice: Subject to any disclaimer, the term of this patent is extended or adjusted under 35 U.S.C. 154(b) by 0 days.

(21) Appl. No.: 09/444,938

(22) Filed: Nov. 22, 1999

(30) Foreign Application Priority Data

Dec. 11, 1998 (FR) ..... 98 15689

(51) Int. Cl.[7] ..... D06F 21/04

(52) U.S. Cl. ..... 8/159; 68/12.02; 68/140; 68/143

(58) Field of Search ..... 8/159; 68/12.02, 68/140, 143, 145

(56) References Cited

U.S. PATENT DOCUMENTS 2,571,197 A * 10/1951 Buss ..... 68/145 X
4,344,198 A * 8/1982 Arendt et al. ..... 8/159 X
5,335,524 A * 8/1994 Sakane ..... 68/12.02 X

FOREIGN PATENT DOCUMENTS

| | | | | |
|---|---|---|---|---|
| DE | 1 159 894 | | 12/1963 | |
| EP | 373063 | | 6/1990 | |
| FR | 1 235 206 | | 5/1960 | |
| GB | 868347 | * | 5/1961 | ..... 68/143 |

* cited by examiner

*Primary Examiner*—Philip R. Coe
(74) *Attorney, Agent, or Firm*—Pearne & Gordon LLP

(57) ABSTRACT

In a linen or clothes washing machine having a drum (12) with a substantially horizontal axis, which is internally subdivided into two compartments (14*a*, 14*b*) by a partition (16) passing through the axis thereof, the drum (12) is rotated at an angular velocity or speed such that the linen (24*a*, 24*b*) is subject to a substantially constant radial acceleration with a mean value between approximately 0.70 and 0.95 g, in which g represents the gravitational acceleration. To this end, the system controlling the rotation of the drum (12) preferably includes a closed loop speed control device. An efficient washing is ensured by making the two linen loads (24*a*, 24*b*) drop whenever the drum performs a half-turn.

10 Claims, 3 Drawing Sheets

PROCESS FOR WASHING LINEN AND WASHING MACHINE PERFORMING SAID PROCESS

DESCRIPTION

1. Technical Field

The invention relates to a process for washing linen or clothes using a washing machine equipped with a rotary drum having a substantially horizontal axis, internally defining two compartments separated by a radial partition passing through said axis.

The invention also relates to a clothes or linen washing machine performing said process.

The linen washing process and the washing machine according to the invention are more particularly applicable to industrial and semiindustrial washing installations, in which relatively large linen loads are treated during each washing cycle.

2. Prior Art

In industrial and semi-industrial washing installations, use is frequently made of washing machines in which two linen loads are simultaneously placed in two compartments of a rotary drum having a substantially horizontal axis. In such washing machines, the two compartments are subdivided by a radial partition passing through the drum axis.

In existing washing machines of this type, the linen is washed by rotating the drum by means of an electric motor controlled by a microprocessor through a speed controller. On starting up, the rotation speed of the drum progressively increases in accordance with a given gradient until a predetermined speed level is reached. This speed level is normally preset in the factory. It corresponds to an angular drum speed such that the linen is subject to a radial acceleration G, which is generally between 0.4 and 0.5 g, in which g represents the gravitational acceleration.

As can be gathered from the attached FIGS. 1A and 1B, the characteristics of such a washing machine do not ensure an efficient washing of the linen.

In FIGS. 1A and 1B references 1 and 2 respectively designate the tank and drum of a washing machine of the aforementioned type. The drum 2 is internally subdivided into two compartments 3*a*, 3*b* by a radial partition 4 passing through the substantially horizontal axis of the drum. A linen load 4*a*, 4*b* is respectively placed in each of the compartments 3*a*, 3*b*.

When the drum 2 rotates about its axis in the direction of the arrow F1 in FIGS. 1A and 1B, each of the linen loads 4*a*, 4*b* is simultaneously subject to the force of gravity Pa, Pb, centrifugal force Ca, Cb and to reaction forces exerted by the walls. Due to the relatively limited angular speed of the drum 2, the vertically downwardly oriented force of gravity Pa, Pb significantly exceeds the centrifugal force Ca, Cb, which is radially oriented towards the outside.

Under these conditions, when the radial partition 4 passes through a substantially horizontal state, the linen loads 4*a* and 4*b*, then respectively located in the upper compartment 3*a* and the lower compartment 3*b*, occupy the positions illustrated in FIG. 1A. More specifically, the linen load 4*a* is then placed in the angle formed between the partition 4 and the circumferential wall of the drum 2 on the upstream side with respect to the rotation direction F1 of the latter. The linen load 4*b* in the lower compartment 3*b* rests on the circumferential wall of the drum 2, at a location relatively close to the angle formed between said wall and the partition 4 on the downstream side with respect to the rotation direction F1.

As illustrated in FIG. 1B, as the rotation of the drum 2 continues in the direction of the arrow F1, the partition 4 is progressively inclined in the same direction. Bearing in mind the relatively limited nature of the centrifugal force applied to the linen compared with the weight thereof, the linen load 4*a* in the upper compartment 3*a* then descends progressively by simply sliding (arrow FG) along the partition 4 to the angle formed between said partition and the circumferential wall of the drum 2 on the downstream side relative to its rotation direction F1. At the same time, the linen load 4*b* in the lower compartment 3*b* progressively descends along the circumferential wall of the drum 2, whilst rolling on itself (arrow FR), until it is placed in the angle or corner formed between said wall and the partition 4 on the upstream side with respect to the drum rotation direction F1.

In existing washing machines of this type, the rotation of the drum 2 consequently leads to a mere displacement of two linen loads 4*a*, 4*b* successively by sliding along the radial partition 4 and by sliding and rolling along the circumferential wall of the drum 2.

However, it has been established that the washing efficiency of a washing machine is essentially due to the number of drops, falls or tumbles undergone by the linen within the rotary drum and the height thereof. More specifically, washing is more efficient as the linen undergoes a higher number of drops over as great a height as possible. From this standpoint, existing washing machines where the tank is subdivided into two compartments by a radial partition have a relatively unsatisfactory washing efficiency.

It should be noted that this problem is specific to washing machines, whose tank is subdivided into two compartments by a radial partition. Thus, at the normal rotation speed of the drum, said partition essentially opposes any drop of the linen, as has been explained relative to FIGS. 1A and 1B. In washing machines lacking such a partition and for the same drum rotation speed, the single linen load contained therein is subject to repeated drops.

Moreover, it is important to note an "orbiting" of the linen, i.e. its locking against the circumferential wall of the drum when the latter performs a complete turn or revolution must be avoided. Such a phenomenon arises when the radial acceleration G applied to the linen reaches 1 g.

DESCRIPTION OF THE INVENTION

The invention relates to a process for washing linen using a washing machine having two compartments and which makes it possible to very significantly improve the efficiency of washing without any risk of the linen orbiting.

According to the invention, this result is obtained by means of a process for washing linen, wherein:

- the linen is placed in two compartments defined within a rotary drum, which has a substantially horizontal axis, by a radial partition passing through said axis and
- the drum is rotated about its axis, characterized in that the drum is rotated at an angular speed such that the linen is subject to a substantially constant radial acceleration G with a mean value between approximately 0.70 g and approximately 0.95 g, where g represents the gravitational acceleration.

By subjecting the linen to such a radial acceleration, it is possible to ensure that each of the two linen loads placed in the drum undergoes a drop on each occasion when the drum rotates by a half-turn. Moreover, each drop takes place over a height close to the diameter of the drum. Thus, an efficient washing of the linen is obtained.

As the angular acceleration to which the linen is exposed remains in all cases below 1 g, there is no risk of linen orbiting.

In a preferred embodiment of the invention, the drum is rotated at an angular speed such that the linen is subject to a substantially constant radial acceleration G, whose mean value is between approximately 0.80 g and approximately 0.90 g.

The drum is preferably rotated at a substantially constant angular speed.

In an embodiment of the invention, the rotation speed of the drum is then measured and a drive motor for the same is controlled so as to make the measured speed substantially constant. This embodiment is more particularly applicable in the case where the motor rotates the drum by transmission means with sliding, e.g. using a smooth belt.

In another embodiment of the invention, applied to the case where the drum is rotated by a motor through sliding-free transmission means, e.g. using a toothed belt, the rotation speed of the motor is measured and is controlled in such a way as to make the measured speed substantially constant.

The invention also relates to a washing machine comprising:

a rotary drum, which has a substantially horizontal axis, internally defining two compartments separated by a radial partition passing through said axis and control means for rotating the drum about its axis, characterized in that said control means rotate the drum at an angular speed such that the linen is subject to a substantially constant radial acceleration G, whose mean value is between approximately 0.70 g and approximately 0.95 g, in which g represents gravitational acceleration.

BRIEF DESCRIPTION OF THE DRAWINGS

The invention is described in greater detail hereinafter relative to two preferred, but non-limitative embodiments and with reference to the attached drawings, wherein show.

DETAILED DESCRIPTION OF PREFERRED EMBODIMENTS OF THE INVENTION

Figure 1A:
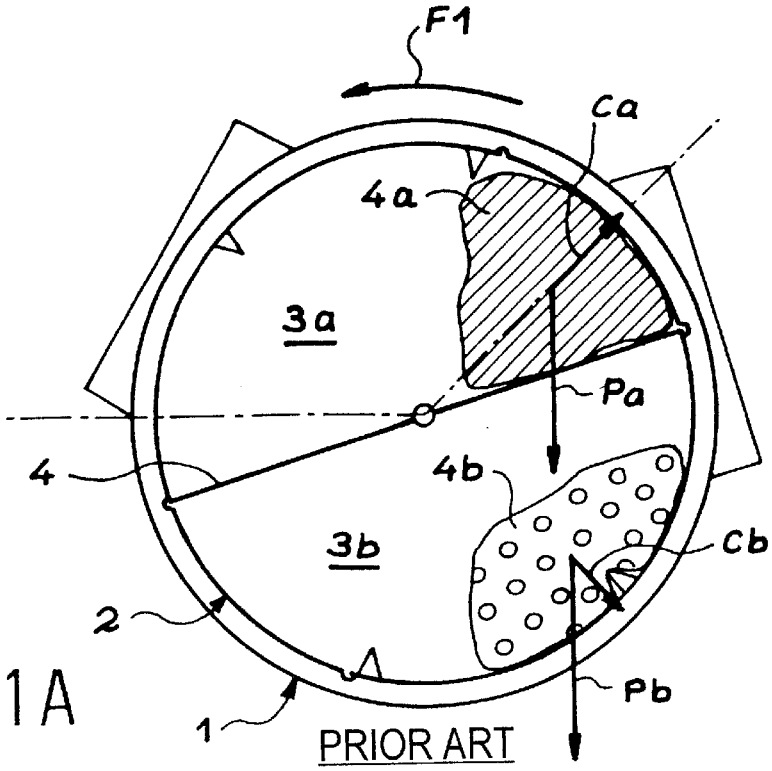
FIGS. 1A and 1B, already described, diagrammatically the displacement of two linen loads received in the two compartments of a washing machine with a radial partition according to the prior art.
Figure 1B:
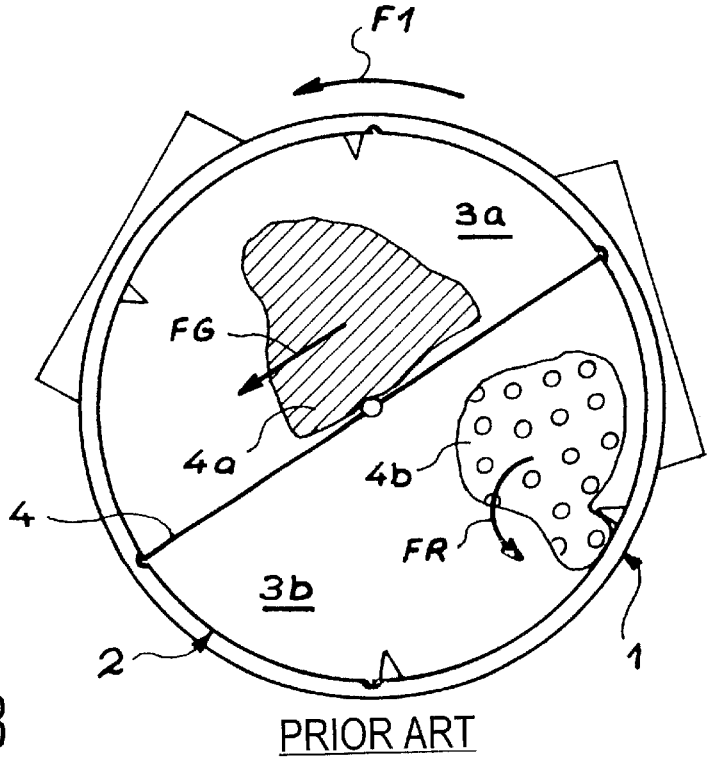
Figure 2A:
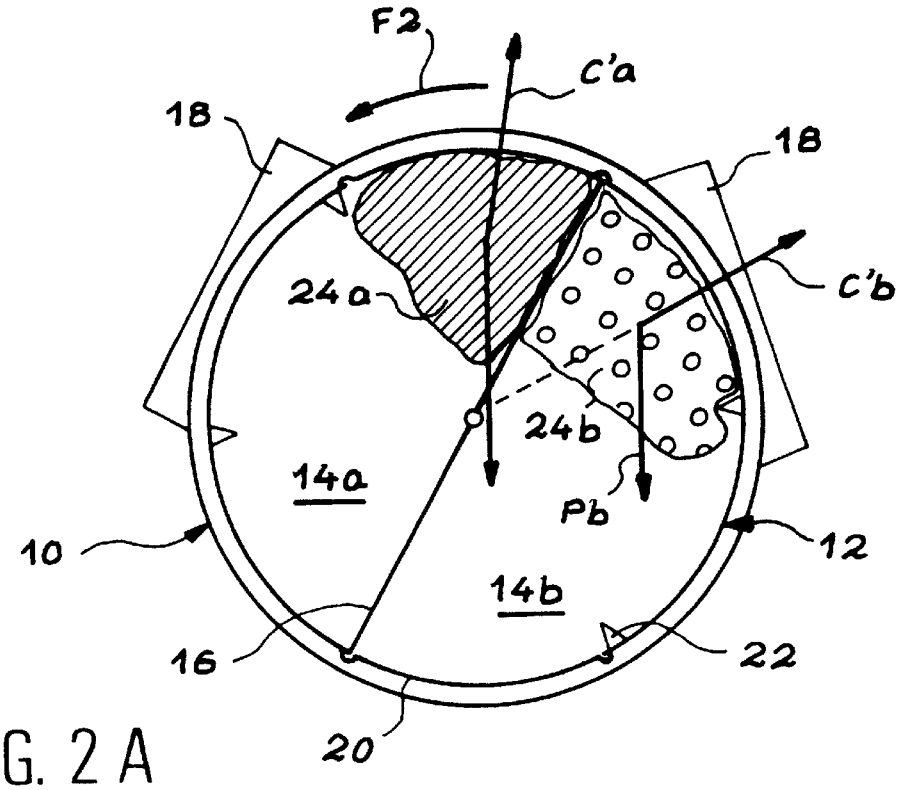
FIGS. 2A and 2B views comparable to FIGS. 1A and 1B, illustrating the displacements of the two linen loads in the drum of the machine according to the invention.
Figure 2B:
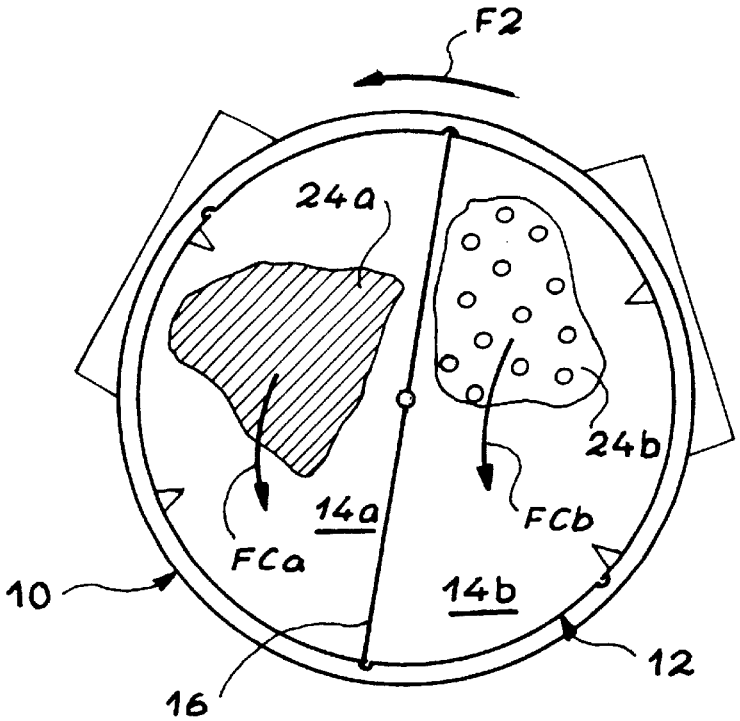

As is more particularly illustrated in FIGS. 2A and 2B, the invention applies to a linen washing machine comprising a tank 10, in which is installed a rotary drum 12 having a substantially horizontal axis. More specifically, the rotary drum 12 is internally subdivided into two compartments 14*a*, 14*b*, by a radial partition 16 passing through the drum axis.

In conventional manner in such a machine, the tank 10 is equipped with two access doors 18 and the drum 12 is also equipped with two not shown doors issuing into each of the compartments 14a, 14b and which can be brought in front of the doors 18, on stopping the drum, e.g. by means of a not shown indexing system.

The drum 12 also comprises two end walls, in the form of disks, as well as a circumferential wall 20 provided with not shown perforations. In each of the compartments 14*a*, 14*b*, the circumferential wall 20 of the drum 12 is internally equipped with ribs 22 having a triangular cross-section, which tend to oppose the sliding of the linen along the wall 12.

The washing machine according to the invention is also equipped with control means for rotating the drum 12 at an angular speed such that the two linen loads to be washed 24*a*, 24*b*, placed in each of the compartments 14*a*, 14*b*, are subject to a substantially constant radial acceleration G, whose mean value is between approximately 0.70 g and approximately 0.95 g, in which g represents gravitational acceleration. Preferably, the mean value of the radial acceleration G is more specifically between approximately 0.80 g and approximately 0.90 g.

As is more particularly illustrated in FIGS. 2A and 2B, this original feature of the washing machine according to the invention makes it possible to ensure a drop of the linen loads 24*a*, 24*b* contained in each of the compartments 14*a*, 14*b* over a height close to the diameter of the drum 12, whenever the latter is rotated by a half-turn.

Thus, the angular rotational speed of the drum 12, which is significantly higher than in existing machines of the same type, makes it possible to subject each of the linen loads 24*a*, 24*b* to a centrifugal force C'a, C'b (FIG. 2A) lower than the force of gravity Pa, Pb, but relatively close to the latter.

Thus, when the drum 12 rotates in the direction of the arrow F2 in FIGS. 2A and 2B, the linen load 24*a* in the upper compartment 14*a* with respect to the partition 16 remains in the corner of said compartment positioned upstream with respect to the rotation direction F2 until the partition 16 assumes an almost vertical position (FIG. 2B). In a comparable manner, the linen load 24*b* in the lower compartment 14*b* with respect to the partition 16 remains in the upstream corner of said compartment, with respect to the drum rotation direction F2, until the partition 16 arrives in the almost vertical position illustrated in FIG. 2B.

Therefore the linen loads 24*a*, 24*b* are separated from the circumferential wall 20 of the drum when the corners in which they are located are oriented upwards. As is shown in FIG. 2B, the linen loads 24*a*, 24*b* then drop by gravity (arrows FCa and FCb) into the opposite corners of their respective compartments over a height virtually equal to the drum diameter. Such a drop occurs whenever the drum performs a half-turn. A more efficient linen washing than in prior art washing machines of the same type is consequently ensured.

Figure 3:
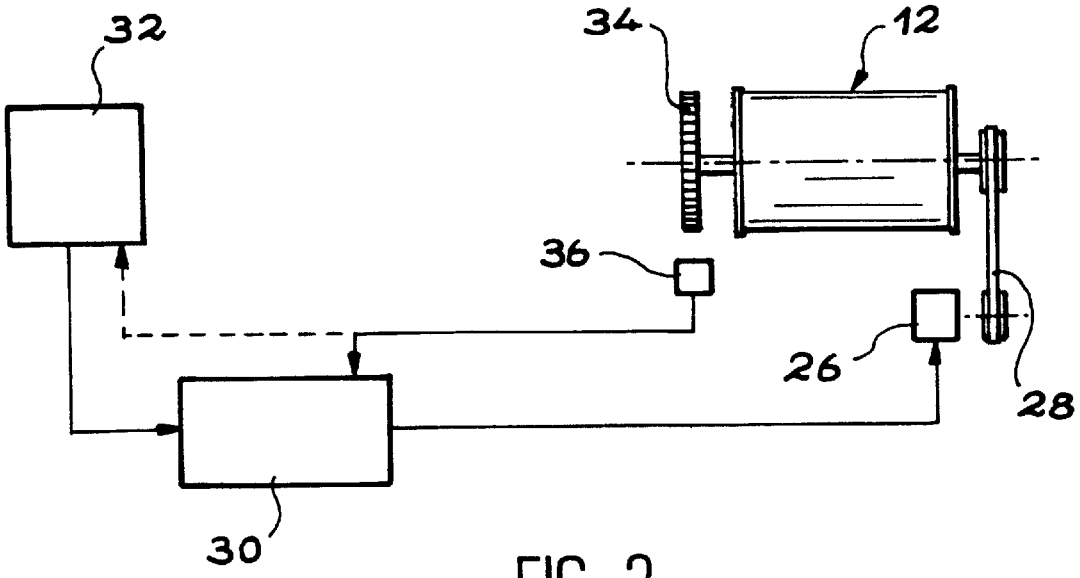
FIG. 3 very diagrammatically in a washing machine according to the invention, a first embodiment of the control means making it possible to rotate the drum at a regulated angular speed.

With reference to FIG. 3, a description will now be given of a first embodiment of the control means making it possible to rotate the drum 12 in the washing machine according to the invention.

As illustrated in FIG. 3, the drum 12 is rotated by an electric motor 26 through transmission means able to induce a certain sliding. In this case, the transmission means comprise a smooth drive belt 28, which passes both on a pulley fixed to the output shaft of the motor 26 and on a pulley fixed to the shaft of the drum 12.

The electric motor 26 is supplied with electric current through a frequency variator 30 controlled by a microprocessor 32. This conventional arrangement ensures the speed rise of the drum 12 and then the maintaining of said speed at a predetermined level. However, the approximate nature of the thus reached speed level, increased by the possible existence of sliding in the transmission, does not make it possible to ensure a regulation of the drum speed at the desired, optimized value.

For this reason, the conventional control means described hereinbefore are advantageously supplemented by closed loop speed control means.

In the embodiment illustrated in FIG. 3 and which more particularly relates to the case of a transmission in which a certain sliding exists, means are provided for directly measuring the rotation speed of the drum 12 about its axis. In the embodiment shown, said means comprise a toothed disk 34 integral with the axis of the drum 12, as well as a pulse transducer 36 positioned facing the periphery of the disk 34. In order to ensure a satisfactory precision with respect to the sought objective, the disk 34 preferably has at least thirty teeth regularly distributed over its periphery.

When the washing machine is operating, the pulse transducer 36 supplies a signal representative of the rotation speed of the drum 12. This signal can be transmitted either directly to control means integrated into the frequency variator 30, as illustrated in continuous line form in FIG. 3, or to a control software equipping the microprocessor 32, as is illustrated by the broken lines. In both cases, the speed signal is processed so as to keep constant the rotation speed of the drum 12 at a level such that the radial acceleration G applied to the linen loads permanently remains at the displayed value, e.g. 0.85 g, with a precision at least equal to 0.1 g.

Figure 4:
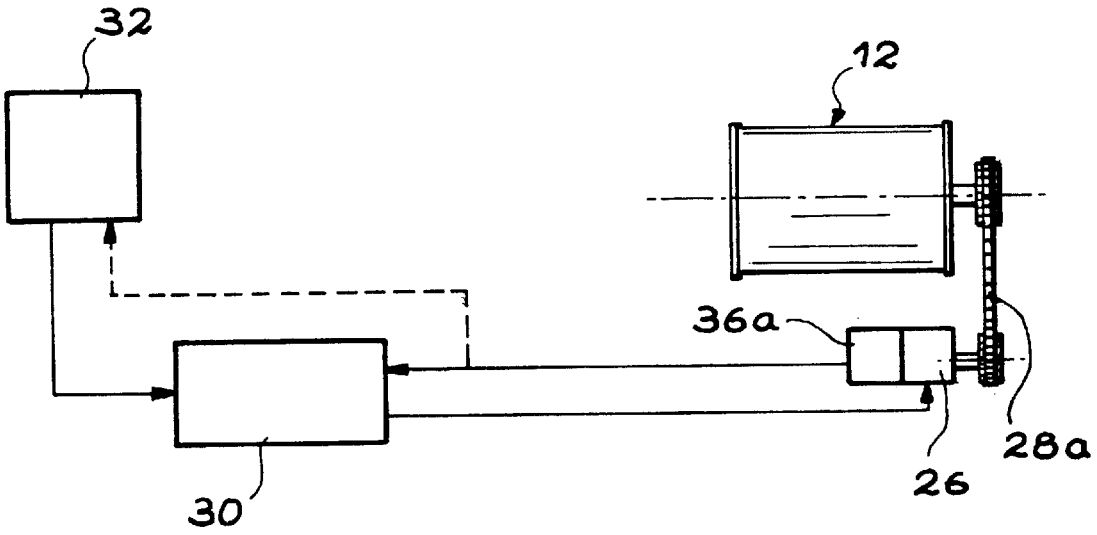
FIG. 4 a view comparable to FIG. 3 illustrating a second embodiment of the invention.

FIG. 4 shows a second embodiment of the control means ensuring the rotation of drum 12. This second embodiment essentially applies to the case where the transmission between the electric motor 26 and the drum 12 is ensured by sliding-free transmission means, which can in particular comprise a toothed belt 38*a* meshing both on a notched pulley fixed to the output shaft of the motor 26 and to a notched pulley fixed to the shaft of the drum 12.

As in the first embodiment illustrated in FIG. 3, the electric power supply of the motor 26 is provided through a frequency variator 30 controlled by a microprocessor 32. However, as the rotation speed of the drum 12 is directly proportional to the rotation speed of the motor 26 (because the transmission is free from sliding), the speed control can in this case take place by measuring the rotation speed of the electric motor 26.

Thus, the washing machine then comprises means for measuring the rotation speed of the motor 26, in this case constituted by a tachometer 36*a*. When the washing machine is operating, the tachometer 36*a* delivers an output signal representing the rotation speed of the motor 26. As a function of the particular case, said signal can either be transmitted directly to a control system integrated into the frequency variator 30, as shown in continuous line form in FIG. 4, or to a control software equipping the microprocessor 32 and as illustrated in discontinuous line form.

Due to the fact that the angular rotational speed of the drum 12 is regulated, according to the invention, in such a way that the linen is permanently subject to a substantially constant radial acceleration G with a mean value between approximately 0.70 g and approximately 0.95 g, an efficient washing of the linen is ensured, as explained hereinbefore relative to FIGS. 2A and 2B.

The preferred addition of a closed loop control avoids excessive fluctuations in the drum rotation speed. This ensures that said speed remains adequate to bring about a significant drop or fall of the two linen loads whenever the drum performs a half-turn, whilst still being sufficiently low to avoid any risk of the linen orbiting within the drum.

What is claimed is:

1. Process for washing linen, in which:

the linen is placed in two compartments defined within a rotary drum, which has a substantially horizontal axis, by a radial partition through said axis and the drum is rotated about its axis, wherein the drum is rotated at an angular speed such that the linen is subject to a substantially constant radial acceleration G with a mean value between approximately 0.70 g and approximately 0.95 g, where g represents the gravitational acceleration.

2. Process according to claim 1, wherein the drum is rotated at a substantially constant angular speed.

3. Process according to claim 2, wherein the rotation speed of the drum is measured and a drive motor is controlled so as to render the measured speed substantially constant.

4. Process according to claim 2, wherein use is made of a drum driven by a motor through sliding-free transmission means, the rotation speed of the motor is measured and the latter is controlled so as to make the measured speed substantially constant.

5. Process according to claim 1, wherein the drum is rotated at an angular speed such that the linen is subject to a substantially constant radial acceleration, whose mean value is between approximately 0.80 g and approximately 0.90 g.

6. Washing machine, comprising:

a rotary drum, which has a substantially horizontal axis, internally defining two compartments separated by a radial partition passing through said axis and control means for rotating the drum about its axis, wherein said control means rotate the drum at an angular speed such that the linen is subject to a substantially constant radial acceleration G, whose mean value is between approximately 0.70 g and approximately 0.95 g, in which g represents gravitational acceleration.

7. Washing machine according to claim 6, wherein the control means rotate the drum at a substantially constant angular speed.

8. Washing machine according to claim 7, wherein the control means comprise:

a motor able to rotate the drum, means for measuring the rotation speed of the drum and emitting a signal representative thereof and control means sensitive to said signal in order to make the rotation speed of the drum substantially constant.

9. Washing machine according to claim 7, wherein the control means comprise:

a motor for rotating the drum through sliding-free transmission means, means for measuring the rotation speed of the motor and for emitting a signal representative thereof and control means sensitive to said signal for rendering the rotation speed of the motor substantially constant.

10. Washing machine according to claim 6, wherein the control means rotate the drum at an angular speed such that the linen is subject to a substantially constant radial acceleration G, whose mean value is between approximately 0.80 g and approximately 0.90 g.

* * * * *